United States Patent [19]

Hall et al.

[11] Patent Number: 4,989,028

[45] Date of Patent: Jan. 29, 1991

[54] APPARATUS FOR PROCESSING LIGHT SENSITIVE MATERIAL

[75] Inventors: Douglas O. Hall, Farmington; Lee F. Frank; Bruce R. Muller, both of Rochester, all of N.Y.

[73] Assignee: Eastman Kodak Company, Rochester, N.Y.

[21] Appl. No.: 426,349

[22] Filed: Oct. 25, 1989

[51] Int. Cl.[5] ..... G03D 3/02; G03D 3/08

[52] U.S. Cl. ..... 354/324; 354/322

[58] Field of Search ..... 354/299, 316, 319, 320, 354/321, 322, 324; 134/64 P, 122 P

[56] References Cited

U.S. PATENT DOCUMENTS

| | | | |
|---|---|---|---|
| 3,192,846 | 7/1965 | Wright | 134/122 P |
| 3,344,729 | 10/1967 | Kitrosser | 354/321 X |
| 3,372,630 | 3/1968 | Schmidt | 354/324 |
| 3,405,627 | 10/1968 | Day et al. | 134/64 P |
| 3,610,131 | 10/1971 | Frick et al. | 134/64 R |
| 3,618,506 | 11/1971 | Kitrosser | 134/122 R |
| 3,641,911 | 2/1972 | Aelterman et al. | 134/64 P |
| 3,688,677 | 9/1972 | Frick et al. | 134/122 R |
| 3,774,521 | 11/1973 | Beck | 354/317 |
| 3,791,345 | 2/1974 | McCutcheon | 118/637 |
| 4,327,988 | 5/1982 | Vanhorebeek et al. | 354/320 |
| 4,359,279 | 11/1982 | Popoff | 354/320 |
| 4,577,949 | 3/1986 | Geyken et al. | 354/319 |

*Primary Examiner*—A. A. Mathews

*Attorney, Agent, or Firm*—G. Herman Childress

[57] ABSTRACT

A photographic apparatus for processing light sensitve material includes a plurality of fluid suspension devices each having an upper applicator housing and a lower applicator housing situated to form an elongated fluid chamber. Processing fluid application means are located adjacent an entrance and exit of the upper and lower applicator housings for applying the fluid to both sides of the light sensitive material to create upper and lower fluid layers, thus suspending the film between the fluid layers as the film travels through the processor. Such suspension minimizes scratches or abrasions to the emulsion.

14 Claims, 5 Drawing Sheets

APPARATUS FOR PROCESSING LIGHT SENSITIVE MATERIAL

BACKGROUND OF THE INVENTION

1. Field of the Invention

The subject invention relates to a photographic processing apparatus for fluid processing a strip or sheet of light sensitive material.

2. Description of the Prior Art

Many conventional photographic processors comprise a plurality of tanks containing various processing fluids, each tank having a plurality of driven rollers. The light sensitive material is driven through the tanks in a generally sinusoidal path wherein the light sensitive material may be continuously contacted by the rollers, thus leading to possible scratching of the material. Typically, the rollers provide agitation of the fluid to attempt to achieve uniform processing of the material.

A variety of photographic processors have been proposed which attempt to reduce the contact between light sensitive material and drive rollers thus reducing the possibility of scratching or marring the material being processed. The proposed processors also aim for uniform distribution of processing fluid directed onto the light sensitive material to obtain a uniform development of the material. It can also be advantageous to contain the processing fluids within their respective tanks to prevent contamination of the processing fluids.

Two such processors are disclosed in U.S. Pat. No. 3,610,131 to Frick et al. and U.S. Pat. No. 3,688,677 to Frick et al.. U.S. Pat. No. 3,610,131 discloses a photographic film treated by liquids that are directed to both sides of the film through a plurality of slit-shaped orifices. The liquids which issue from the orifices flow counter to the direction of film travel and contribute to proper guidance of the film during travel through the treating stations. However, it is possible that the liquid will not reach some areas of the film when the liquid issues from the orifices.

U.S. Pat. No. 3,688,677 discloses apparatus wherein fluid is directed through an elongated slit-shaped orifice thus issuing a wide stream of fluid onto the film. The fluid is supplied to the orifice through inlet openings designed to insure that the inflow of fluid into the chambers takes place with a minimum of turbulence, thus low agitation of the fluid occurs which could result in slower processing times.

In a photographic processing apparatus disclosed in U.S. Pat. No. 4,359,279 to Popoff processing liquid is applied to the photographic material by projecting a plurality of streams both downward onto the material and upward from an underlying plate, hence the material is supported by the processing liquid. This processing apparatus also has the disadvantage that the liquid may not reach some areas of the photographic material when projected onto the material.

A developing device disclosed in U.S. Pat. No. 4,577,949, to Geyken et al. directs processing liquid to both sides of a film traveling through the device. The liquid is pumped from a bath containing processing liquid into a liquid admitting chamber then onto the film. The liquid admitting chamber comprises two passage portions, the first portion being considerably reduced in cross-section starting from the inlet point and the second portion being separated from the first portion by a comb. As the liquid is pumped under pressure through the first portion a vortex may form which can cause non-uniform streams hence non-uniform liquid distribution, therefore non-uniform development of the film. The liquid flows through the teeth of the combs into the second portion attempting to break up the generated vortex before the liquid reaches the film.

In one embodiment disclosed in U.S. Pat. No. 3,372,630 to Schmidt a strip of light sensitive film is supported on liquid cushions of processing liquids as the film is transported through the processor. The liquid is directed at both sides of the film at a plurality of spaced apart locations through slits. The processor further includes "gas seals" to minimize chemical carry-over on the film surfaces from one treating chamber to the next, which can add unnecessary parts to the processor.

SUMMARY OF THE INVENTION

The invention is directed to a fluid suspension apparatus for receiving a processing fluid for processing a strip or sheet of light sensitive material such that the processing apparatus is easily manufacturable and is reliable. The fluid suspension apparatus of the subject invention provides uniform processing of the light sensitive material and improved transport of the material through the apparatus. Furthermore, the fluid suspension apparatus of the subject invention provides for fresh, clean processing fluid to be applied to the light sensitive material at all times.

The fluid suspension apparatus comprises a device defining an elongated fluid chamber. The fluid chamber has an entrance at one end and an exit at the other end so that the light sensitive material is allowed to travel through the suspension apparatus. The suspension apparatus further includes processing fluid application means for applying the processing fluid to the light sensitive material. The applicator means are located at both the entrance and the exit of the device such that a uniform flow of processing fluid is provided to the light sensitive material. Fluid layers are created on opposite sides of the light sensitive material. The light sensitive material is suspended between the fluid layers as it passes through the suspension apparatus. Hence, there is minimal contact between the material and other elements of the suspension apparatus.

BRIEF DESCRIPTION OF THE DRAWINGS

Other advantages of the invention will become apparent from the following description taken in connection with the accompanying drawings wherein.

DETAILED DESCRIPTION OF THE PREFERRED EMBODIMENT

Because photographic processors and the general operations associated therewith are well known in the art, the description hereinafter will be directed in particular only to those processor parts relevant to the present invention. It is to be understood, however, that processor components not specifically shown or described may take various forms selectable from those known in the art.

Figure 1:
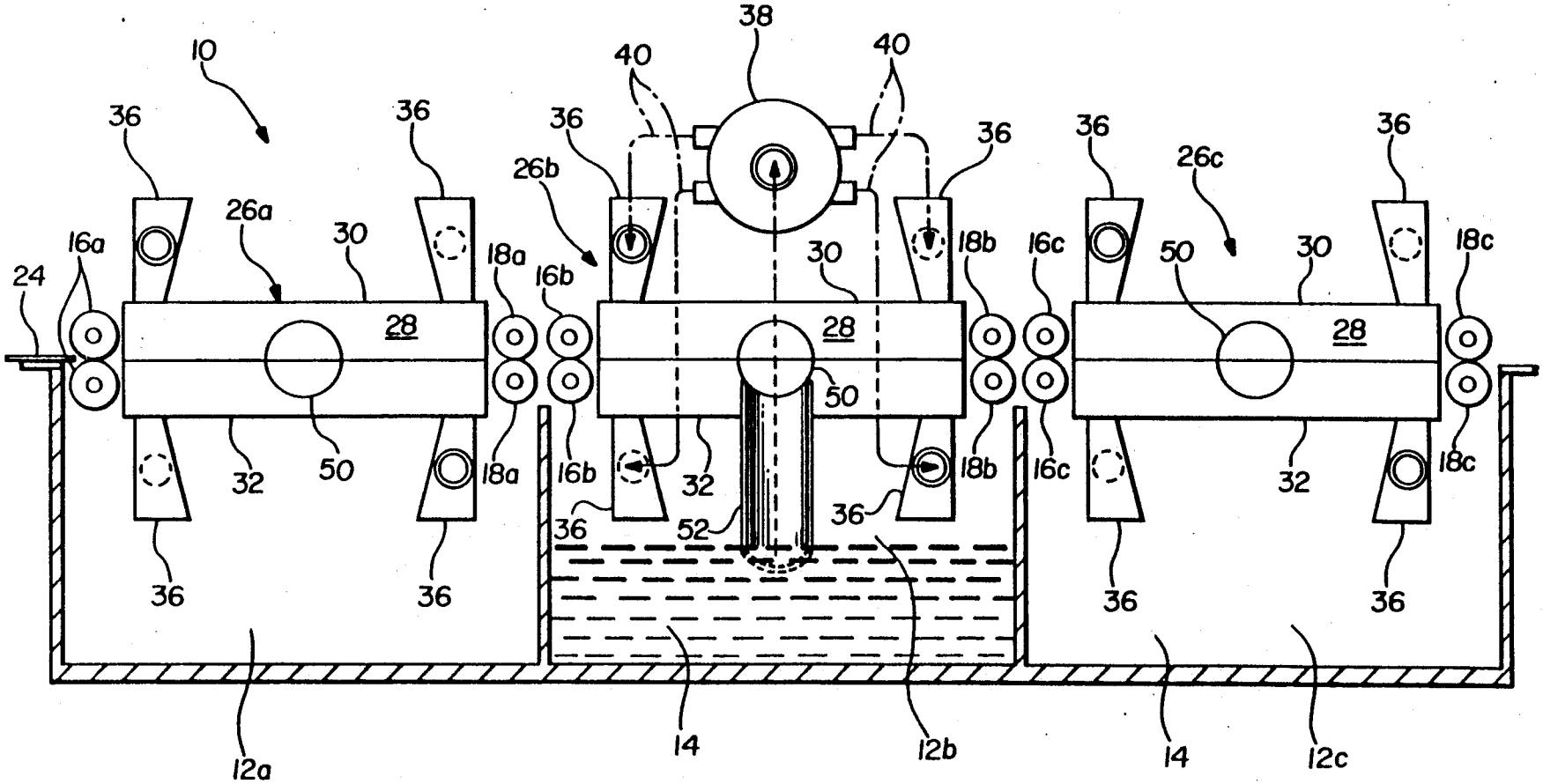
FIG. 1 is a side view of a photographic processing apparatus in accordance with the invention.

Referring to FIG. 1 of the drawings a photographic processing apparatus 10 in accordance with the present invention comprises a plurality of tanks 12*a*,12*b*,12*c* wherein supplies of processing fluids 14 are respectively contained. The processing fluids 14 can be a type of liquid such as developer, fixer, bleach, water, or other liquid used during photographic processing; or the fluid 14 can be in a gaseous form. Due to the corrosiveness of some of the processing fluids 14 the tanks 12*a*,12*b*,12*c* and other elements of the photographic processor 10 should be made of plastic or other non-corrosive materials such as stainless steel. A plurality of fluid suspension devices 26*a*,26*b*,26*c* are respectively associated with the tanks 12*a*,12*b*,12*c* for processing sheets or strips of a light sensitive material 24, film or paper. It is obvious to one skilled in the art that any number of tanks can be used in the photographic processing apparatus depending on which type of light sensitive material is to be processed.

Figure 5:
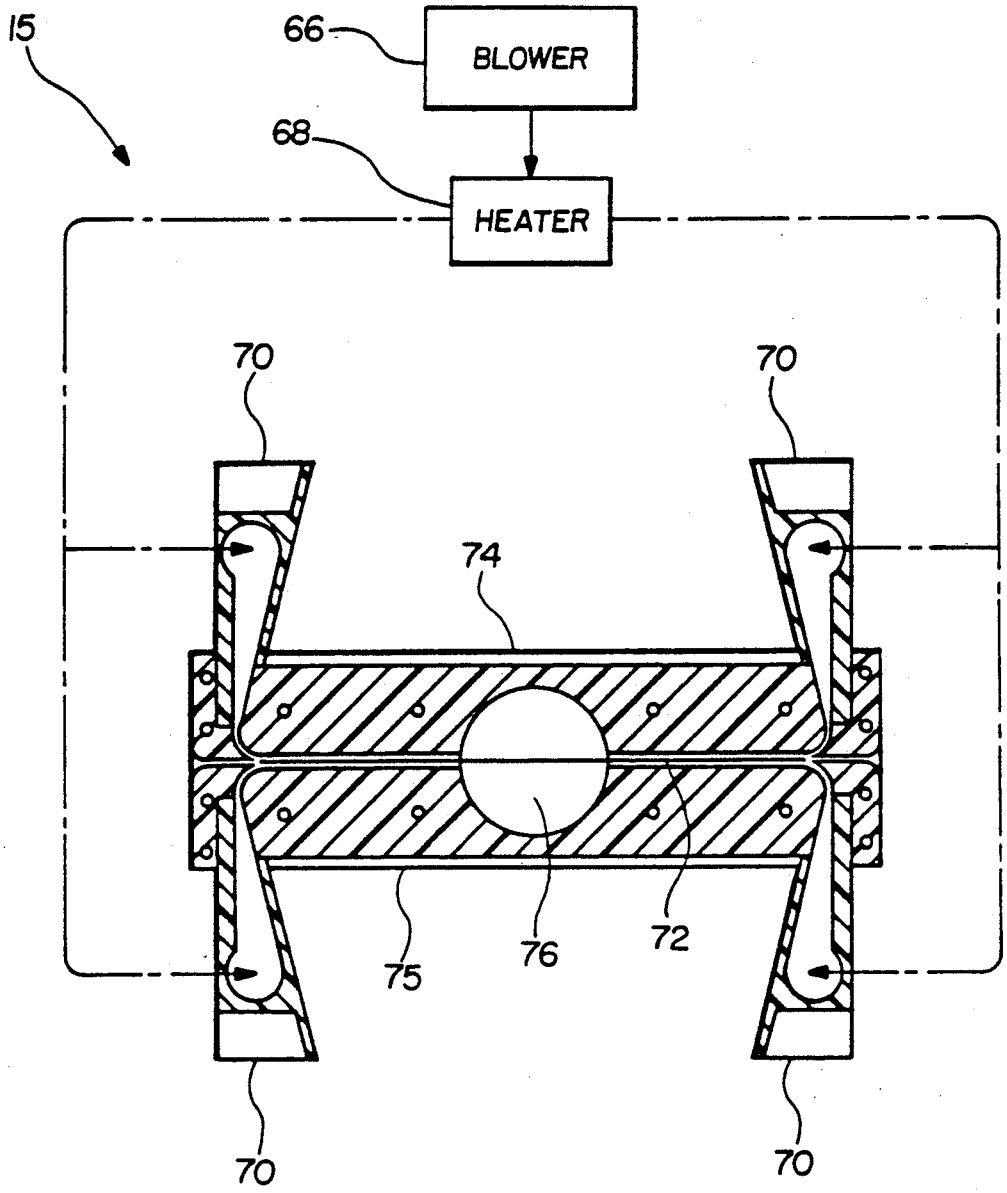
FIG. 5 is a cross section of a dryer section embodying the present invention.

The photographic processing apparatus 10 may also include a dryer section which can be any conventional hot air, radiant, or infrared dryer or any combination of such dryers. Or a dryer section 15 embodying the present invention which is shown in FIG. 5 can be used.

Figure 2:
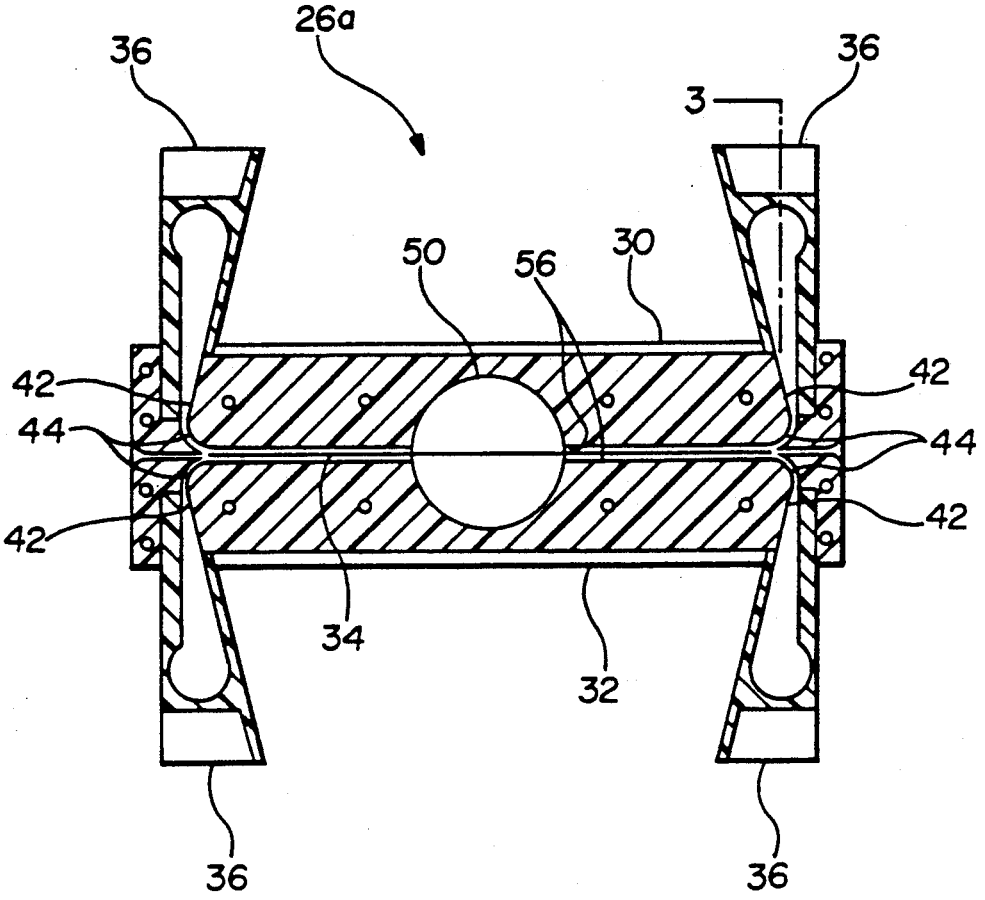
FIG. 2 is a cross section of a fluid suspension apparatus.

Referring now to FIGS. 1 and 2 the fluid suspension apparatus 26 will be described more fully. The fluid suspension apparatus 26 comprises a device 28 having a first, or an upper, applicator housing 30 and a second, or a lower, applicator housing 32 defining an elongated fluid chamber 34 therebetween. A pair of nip rollers 16 are positioned adjacent to a film entrance of each chamber 34 and a pair of nip rollers 18 are positioned adjacent a film exit for conveying the film through the fluid chambers 34 of the devices 26*a*,26*b*,26*c*. According to the present invention the rollers 16*a* can be formed from any rigid material such as a hard plastic or a steel. The rollers 18*a*,16*b*,18*b*,16*c*, and 18*c* can be made from a soft material such as rubber or foam rubber and the like which are typically used in conventional photographic processors. In this manner the rollers 18*a*,16*b*,18*b*,16*c*, and 18*c* can be assembled such that the rubber compresses and excess fluid 14 is removed from the film 24 in a squeegee type action as it travels between the fluid suspension devices 26*a*,26*b*,26*c*.

Referring now to the structure of each device 26 means for applying the processing fluid 14 to the film 24 is provided by processing fluid application means including a plurality of slot nozzles 36 located at the entrance and exit of the upper applicator housing 30 and at the entrance and exit of the lower applicator housing 32 to create fluid layers on opposite sides of the film 24 whereby the film 24 is suspended between an upper fluid layer and a lower fluid layer as it travels through the fluid chamber 34. The locations of the slot nozzles 36 are conducive to confining the processing fluid 14 to their respective fluid suspension devices 26 thus avoiding cross mixing of the fluids 14. The nozzles 36 are situated such that the fluid 14 flows towards the center of the device 26. The placement of the nozzles 36 together with the velocity of the fluid 14 prevents the fluid 14 from escaping between the rollers 16,18 into a nearby tank, thus preventing contamination of the fluid 14 present in a proximate tank. Furthermore, the locations of the nozzles 36 allow fresh, clean processing fluids 14 to be continually applied to the film 24 at the entrance and the exit of the fluid chamber 34 as the film 24 travels through the devices 26*a*,26*b*,26*c*, thus eliminating the possibility of the film 24 being exposed to by products of used or old processing fluids 14 as the film 24 exits the devices 26. The slot nozzles 36 are attached to the upper and lower applicator housings 30,32 by any conventional means such as screws, welds or adhesives such that a slot portion 42 of the nozzle 36 meets with a slit-shaped orifice 44 which extends transversely over the width of the applicator housings 30,32. Hence a wide, uninterrupted stream of processing fluid 14 will be directed to the film 24 as the film 24 advances through the fluid chamber 34.

The processing fluid 14 is supplied to the slot nozzle 36 from the tank 12 through a pump 38 and a supply conduit 40 shown schematically in FIG. 1 in connection with the device 26*b*. The temperature of the processing fluid 14 is regulated by a conventional thermowell, not shown. A drain 50 is situated between the entrance and exit of each of the upper and lower applicator housings 30,32 to allow the processing fluid 14 to be removed from the applicator housings 30,32 and flow into the tank 12. The location of the drain 50 between the entrance and exits of the applicator housings 30,32 provides a minimal amount of back pressure to the system. This location also ensures that the fluid 14 from the slot nozzles 36 attached to the upper housing 30 is exhausted upwards and the fluid 14 from the nozzles 36 attached to the lower housing 32 exhausts downwards, thus ensuring that the film 24 will remain centered between the fluid laYers. In accordance with the present embodiment, the processing fluid 14 flows down a chute 52 from the drain 50 to the tank 12 to provide a laminar flow of the fluid 14 into the tank 12 to prevent the possibility of air entrapment in the fluid 14 and thus oxidation of the fluid 14 stored in the tank 12. The devices 26*a* and 26*c* will have identical plumbing apparatus as device 26*b*.

Figure 3:
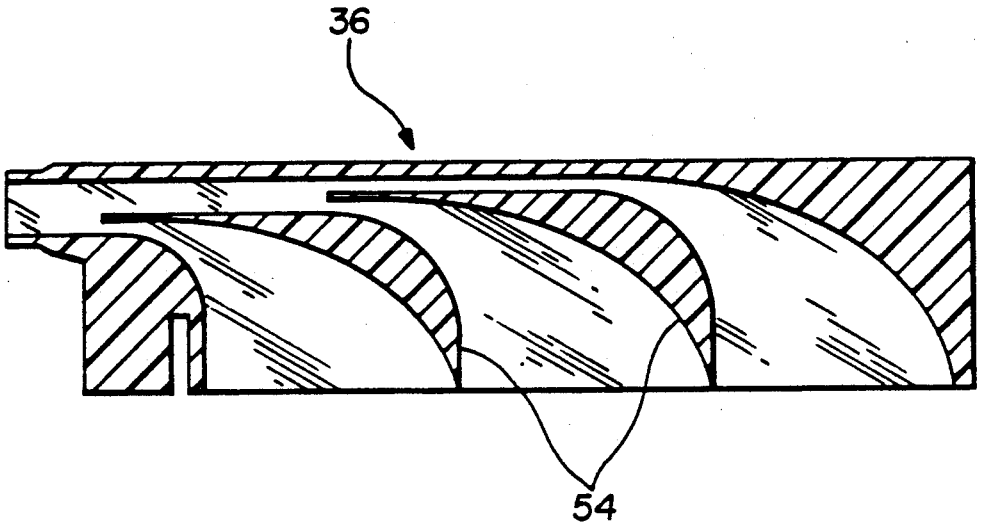
FIG. 3 is an elevational view, in section taken along the line 3—3 in FIG. 2 showing the slot nozzle arrangement.

The configuration of the slot nozzle 36 will now be described in more detail referring to FIG. 3. The nozzle 36 is configured such that a cylindrical fluid flow from the supply conduit 40 is converted to a long, thin rectangular fluid flow exiting the nozzle 36 with minimal hydraulic pressure losses, thus maintaining a turbulent fluid flow through the nozzle 36 providing for an efficient chemical processing reaction. Hydraulic pressure losses are minimized since the cross sectional area at any point inside the nozzle 36 is equal to or less than the cross sectional area of the supply conduit 40. In the present embodiment a uniform cross sectional area is maintained in the slot nozzle 36 through the use of a plurality of vanes 54. The maintaining of the uniform cross sectional area throughout the nozzle 36 further provides for a constant fluid velocity through the nozzle 36. The constant fluid pressure and constant fluid velocity through the nozzle 36 provides for a uniform flow of fluids 14 through the nozzle 36 which is desirable for uniform development of the film 24.

The flow path of the fluid 14 started by the nozzle 36 is completed by the upper and lower applicator housings 30,32. It is advantageous for the fluid 14 to remain in a turbulent state for uniform development of the film 24. Therefore the working surfaces 56 of the upper and lower housings 30,32 should have a surface structure which disrupts the flow of the fluid 14 causing eddies, hence turbulent flow. The eddies which are created should be small, continuous and extremely numerous in order to maintain the uniform flow of the fluid 14 for consistent development of the film 24. The working surface 56 should further be configured to prevent damage to the emulsion of the film 24 being processed. According to an embodiment of the present invention, the working surface 56 is highly polished with a matte finish for maintaining the turbulent flow of the fluid 14 and for preventing scratching of the film 24.

Figure 4:
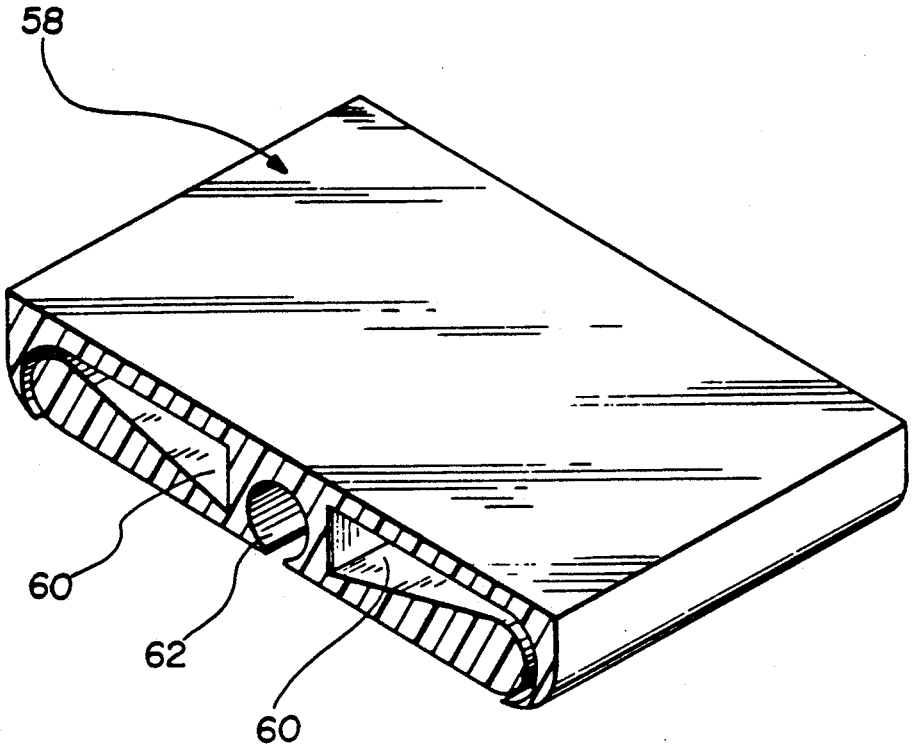
FIG. 4 is a perspective view of another embodiment of t/e fluid suspension apparatus.

Referring to FIG. 4 the applicator means can also be configured as an integral part of the applicator housings. The upper and lower housings are substantially identical, therefore only the upper housing will be described. An upper applicator housing 58 includes slot nozzles 60 which can be molded into the housing 58. The cross sectional area is similar to that of slot nozzle 36. The applicator housing 58 also includes a drain 62 located at the midpoint of the housing 58.

The dryer section 15 embodying the present invention will now be described referring to FIG. 5. A gaseous fluid 64, such as air, is brought into the dryer section 15 through a blower 66 which can be of any conventional design. The air 64 is heated by a conventional heater 68 before being applied to both sides of the film 24 through gaseous fluid application means including a plurality of nozzles 70 attached to an entrance and an exit of a first housing 74 and a second housing 75. The nozzles 70 are similar in construction to nozzles 36. The air 64 travels towards the center of a predetermined path 72 defined by the first and second housings 74,75. The first and second housings 74,75 are similar in structure to the upper and lower applicator housings 32,34. The air 64 is then exhausted through openings 76 and is either recirculated or blown out into the surrounding atmosphere. A pair of nip rollers (not shown) are located at the entrance and exit of the dryer section 15 for transporting the film 24 through the dryer section 15. As mentioned previously, the dryer section 15 can also include infra-red drying elements or radiant drying elements.

The operation of the photographic processing apparatus 10 will now be described in detail referring to FIG. 1. The method of processing for a sheet of exposed film will be described embodying the present invention. Of course, it is obvious to one skilled in the art that any photographic material can be transported through the photographic processing apparatus 10 provided the correct processing fluids 14 are supplied to the processing apparatus 10.

The film 24 is driven into the first fluid suspension device **26*a* by the first set of drive rollers 16*a*. The film 24 follows a straight line path through the fluid chamber 34 between the upper and lower applicator housings 30,32. The first tank 12*a* contains a developer solution which is supplied to the slot nozzles 36 through a pump 38 and supply conduit 40 identical to that illustrated in connection with device 26*b*. The developer solution flows through the slot nozzle 36 and the slit-shaped orifice 44 onto the film 24 in such a manner to provide uniform development of the film 24** as was described heretofore.

The rollers **16*a* continue driving the film 24 through the processing apparatus 10. Excess developer solution is removed from the film 24 through the squeegee-action of the rollers 18*a*. This excess developer solution drains back into the first tank 12*a***.

The next tank **12*b* contains a fix solution which is supplied to the film 24 through the slot nozzles 36 and the slit-shaped orifice 44 as the film 24 travels through the next fluid suspension device 26*b*. The rollers 18*b* adjacent to the exit of this fluid suspension device 26*b* remove the excess fix solution from the film 24 with a squeegee-type action as the rollers drive the film 24 towards the next fluid suspension device 26*c* connected to tank 12*c*** containing wash water.

The wash water is supplied to the film 24 through the slot nozzles 36 and the slit-shaped orifice 44. A pump 38 provides the wash water to the slot nozzle 36 through the supply conduit 40. The film 24 is then driven by the rollers **18*c* adjacent the exit of the fluid suspension device 26*c* associated with the wash water tank. These rollers 18*c* remove excess wash water from the film 24 before the film 24** travels to the dryer section.

The nip rollers located adjacent the entrance of the dryer section 15 pick up the film 24 and transport the film 24 through the path 72. Hot air 64 is applied to the film 24 through the nozzles 70 as the film 24 travels along the path 72. The film 24 then exits the processor through the nip rollers located adjacent the exit of the dryer section 15.

A photographic processing apparatus has been described that provides faster processing times of the film as a consequence of the uniform fluid velocity and the higher, more uniform turbulence of the fluid. Scratching and marring of the film is nearly eliminated due to the suspension of the film between the fluid layers as the film travels through the apparatus. Furthermore, contamination of the processing fluids is virtually eliminated. Moreover, the processor contains fewer parts than conventional roller processors thus reducing manufacturing costs and increasing reliability of the processor.

The present invention has been described in detail with particular reference to a preferred embodiment thereof, but it will be understood that variations and modifications can be effected within the spirit and scope of the invention.

We claim:

1. A fluid suspension apparatus for receiving a processing fluid for processing a strip or sheet of light sensitive material, said apparatus comprising:

a device defining an elongated fluid chamber having an entrance at one end and an exit at the other end to allow the light sensitive material to travel through the suspension apparatus; and processing fluid application means for applying the processing fluid to the light sensitive material, said means being located at said entrance and exit of said device to create fluid layers on opposite sides of the light sensitive material so that the fluid flows towards a midpoint of said device, whereby the light sensitive material is suspended between said fluid layers as the material travels through the suspension apparatus.

2. A fluid suspension apparatus for receiving a processing fluid for processing a strip or sheet of light sensitive material, said apparatus comprising:

a first applicator housing and a second applicator housing defining a fluid chamber having an entrance at one end and an exit at the other end to allow the light sensitive material to travel through the suspension apparatus; and processing fluid application means for applying the processing fluid to the light sensitive material, said means being located at said entrance and exit of said applicator housings to create fluid layers on opposite sides of the light sensitive material so that the fluid flows towards a midpoint of said applicator housings, whereby the light sensitive material is suspended between said fluid layers as the material travels through the suspension apparatus.

3. A fluid suspension apparatus as defined in claim 2 wherein said applicator housings include a surface extending along said fluid chamber, said surface having a polished matte finish for producing turbulent fluid flow.

4. A fluid suspension apparatus as defined in claim 2 wherein said processing fluid application means includes a slot nozzle having a uniform cross sectional area throughout said nozzle.

5. A fluid suspension apparatus as defined in claim 4 further including:

a supply conduit for providing the processing fluid to said slot nozzle; and wherein said cross sectional area of said nozzle is less than or equal to said supply conduit cross sectional area for maintaining a constant fluid velocity and fluid pressure.

6. A fluid suspension apparatus as defined in claim 2 wherein said application means are attached to said entrance and exit of said first and second applicator housings such that the processing fluid is confined to the suspension apparatus.

7. A fluid suspension apparatus as defined in claim 2 further including a first drain and a second drain located at the midpoints of said applicator housings for removing the processing fluid from the suspension apparatus.

8. A photographic processing apparatus for processing a strip or sheet of light sensitive material, said apparatus comprising:

a plurality of fluid suspension devices for receiving a plurality of processing fluids respectively, each having a first applicator housing and a second applicator housing;

a plurality of fluid chambers defined by recessed adjacent surfaces of said first and second applicator housings having an entrance and an exit to allow the light sensitive material to travel through said suspension device;

processing fluid application means for applying the processing fluid to the light sensitive material, said means being located at said entrance and exit of said applicator housings to create fluid layers on opposite sides of the light sensitive material so that the fluid flows towards a midpoint of said applicator housings, whereby the light sensitive material is suspended between said fluid layers as the material travels through said suspension device; and a first drain and a second drain located at the midpoints of said applicator housings for removing the processing fluid from said suspension device.

9. A photographic processing apparatus for fluid processing a strip or sheet of light sensitive material, said apparatus comprising:

a plurality of fluid suspension devices for receiving a plurality of processing fluids respectively, each having an upper applicator housing and a lower applicator housing;

a plurality of fluid chambers defined by recessed adjacent surfaces of said upper and lower applicator housings having an entrance and an exit to allow the light sensitive material to travel through said suspension device; and a plurality of slot nozzles for applying the processing fluid to the light sensitive material, said nozzles being located at said entrance and exit of said applicator housings to create upper and lower fluid layers on opposite sides of the light sensitive material so that the fluid flows towards a midpoint of said applicator housings, whereby the light sensitive material is suspended between said upper and lower fluid layers as the material travels through said suspension device.

10. A photographic processing apparatus as defined in claim 9 wherein said adjacent surfaces of said applicator housings have a polished matte finish for disrupting the fluid flow to produce turbulent fluid flow.

11. A photographic processing apparatus as defined in claim 9 wherein said slot nozzles include a uniform cross sectional area throughout said nozzle.

12. A photographic processing apparatus as defined in claim 11 further including:

a supply conduit for providing the processing fluid to said slot nozzle; and wherein said cross sectional area of said nozzle is equal to or less than said supply conduit cross sectional area for maintaining a constant fluid velocity and fluid pressure.

13. A photographic processing apparatus as defined in claim 9 wherein said slot nozzles are attached to said entrance and exit of said upper and lower applicator housings such that the processing fluid is confined to said suspension device.

14. A fluid suspension apparatus as defined in claim 9 further including an upper drain and a lower drain located at the midpoints of said applicator housings for removing the processing fluid from said suspension device.

* * * * *